US006758419B2

(12) United States Patent
Yildirim et al.

(10) Patent No.: US 6,758,419 B2
(45) Date of Patent: Jul. 6, 2004

(54) FUEL INJECTOR

(75) Inventors: Fevzi Yildirim, Gerlingen (DE); Michael Huebel, Gerlingen (DE); Christian Doering, Stuttgart (DE); Juergen Stein, Illingen (DE)

(73) Assignee: Robert Bosch GmbH, Stuttgart (DE)

( * ) Notice: Subject to any disclaimer, the term of this patent is extended or adjusted under 35 U.S.C. 154(b) by 187 days.

(21) Appl. No.: 09/913,657

(22) PCT Filed: Dec. 14, 2000

(86) PCT No.: PCT/DE00/04450

§ 371 (c)(1),
(2), (4) Date: Nov. 9, 2001

(87) PCT Pub. No.: WO01/44652

PCT Pub. Date: Jun. 21, 2001

(65) Prior Publication Data

US 2002/0125343 A1 Sep. 12, 2002

(30) Foreign Application Priority Data

Dec. 16, 1999 (DE) ..... 199 60 605

(51) Int. Cl.[7] ..... B05B 1/30
(52) U.S. Cl. ..... 239/585.4; 251/129.14
(58) Field of Search ..... 239/585, 585.1, 239/585.3, 585.4, 585.5; 251/129.14, 129.16, 129.17, 129.21, 139, 141

(56) References Cited

U.S. PATENT DOCUMENTS 4,471,914 A * 9/1984 Hafner et al. ..... 239/585.3
4,582,085 A * 4/1986 Hafner et al. ..... 239/585.3
4,830,286 A * 5/1989 Asslaender et al. ..... 239/585.3
4,832,314 A * 5/1989 Trott ..... 251/129.16
5,381,965 A * 1/1995 Chabon et al. ..... 239/585.1
5,417,373 A 5/1995 Facchin
5,769,391 A * 6/1998 Noller et al. ..... 251/129.21
6,045,116 A * 4/2000 Willke et al. ..... 251/129.21
6,182,943 B1 * 2/2001 Steinruck et al. ..... 251/129.16

FOREIGN PATENT DOCUMENTS

| | | |
|---|---|---|
| DE | 31 43 849 | 5/1983 |
| DE | 35 35 438 | 4/1987 |
| DE | 37 04 543 | 8/1988 |
| DE | 37 14 693 | 11/1988 |
| EP | 0 68 3 862 | 6/1995 |
| GB | 2 178 483 | 2/1987 |
| GB | 2 213 650 | 8/1989 |

* cited by examiner

*Primary Examiner*—Michael Mar
*Assistant Examiner*—Thach H Bui
(74) *Attorney, Agent, or Firm*—Kenyon & Kenyon

(57) ABSTRACT

A fuel injector for fuel injection system of an internal combustion engine includes a solenoid coil, an armature acted upon in a closing direction by a return spring, and a valve-closure member frictionally connected to the armature. The valve-closure member, together with a valve-seat surface, forms a sealing seat, the armature striking with an armature stop face against a magnetic-pole surface of a magnet body. The armature stop face includes a first annular, inner edge zone that adjoins an inner edge and is inclined inwardly with respect to a plane perpendicular to longitudinal axis of the armature, and has a second annular, outside edge zone that adjoins an outer edge and is inclined outwardly with respect to a plane perpendicular to the longitudinal axis of the armature.

10 Claims, 4 Drawing Sheets

FUEL INJECTOR

FIELD OF THE INVENTION

The present invention relates to a fuel injector.

BACKGROUND INFORMATION

In German Published Patent Application No. 35 35 438 is discussed an electromagnetically operable fuel injector which has, in a housing, a solenoid coil surrounding a ferromagnetic core. A flat armature is arranged between a valve-seat support permanently joined to the housing, and the end face of the housing. The flat armature cooperates with the housing and core via two air gap insurances (or working air gaps), and is guided radially by a guidance membrane which is mounted to the housing and embraces a valve-closure member. The connection between the flat armature and the valve-closure member is produced via a ring that surrounds the valve-closure member and is welded to the flat armature. A helical spring applies closing pressure to the valve-closure member. Fuel channels, as well as the geometry of the flat armature, particularly the depression of the regions adjacent to the fuel channels, allow fuel to circumflow the armature.

It is believed that a disadvantage of such a fuel injector is the high cavitation tendency through the large cavities, traversed by the fuel, in which fluxes and swirl effects develop. Because of the high resistance to flow, the displacement of the fuel upon pull-up of the armature may take place in a delayed manner, and therefore may have disadvantageous effects on the opening time of the fuel injector. In addition, the cavitation is intensified due to the position of the flow-through openings which are placed not at the apex, but rather in the flank of the flat armature.

In German Published Patent Application No. 31 43 849, a similarly formed flat armature is used in a fuel injector. It may be that in this case, the flow-through openings are placed at the apexes of the flat armature; however, due to the armature edge which is still raised, is aligned parallel to the armature stop face and makes displacement of the fuel into the edge areas of the armature impossible, it is believed that the hydrodynamic properties are not essentially improved.

In European Patent No. 0 683 862 is discussed an electromagnetically operable fuel injector whose armature is characterized in that the armature stop face facing the internal pole is slightly wedge-shaped in order to minimize or completely eliminate the hydraulic damping upon opening the fuel injector and the hydraulic adhesion force after switching off the current energizing the solenoid coil. In addition, owing to suitable measures such as vapor deposition and nitration, the stop face of the armature is wear-resistant, so that the stop face has the same size during the entire service life of the fuel injector, and the functioning method of the fuel injector is not impaired.

Disadvantageous in such a fuel injector is that, in spite of the optimized armature stop face, primarily the hydraulic damping force still exists in the working gap upon pull-up of the armature. If an excitation current is applied to the solenoid coil, the armature moves in the direction of the internal pole and, in so doing, displaces the fuel present between the internal pole and the armature. Because of frictional and inertia effects, a local pressure field builds up which produces on the armature stop face a hydraulic force that acts counter to the moving direction of the armature. The opening and fuel-metering times of the fuel injector are thereby prolonged.

SUMMARY OF THE INVENTION

The exemplary fuel injector of the present invention is believed to have the advantage that, by suitable geometric design of the armature, the hydraulic damping force is considerably reduced and thus the fuel injector can be opened more quickly, resulting in more precise metering times and quantities.

A favorable geometry of the armature stop face is achieved by the opposing slope of the edge areas of the armature stop face. The armature possesses two annular edge zones, the inner edge zone being inclined inwardly toward the inside radius, while the outer of the edge zones is inclined outwardly toward the outside radius. The armature stop face is therefore bounded by sloped surfaces. The slope angle of the boundary surfaces influences the flow behavior of the fuel in the working gap. The armature stop face is reduced in size by the geometric design, which means the area subject to wear is smaller.

It is also believed that an advantage is provided by the placement of axial channels in the armature which provide the fuel present in the working gap the possibility of flowing off through them upon actuation of the armature. The channels are arranged in depressions, the flow behavior thereby further improving, since the fuel can escape without delay through the armature.

The same effect can also be attained by cutouts which are spaced evenly at the outer edge of the armature. In this case, due to the outwardly beveled shape of the armature stop face, the fuel is displaced to the outer edge of a central fuel-injector opening accommodating the armature and can flow off through the cutouts in the armature.

The depressions can be bounded by one sloping and one perpendicular surface. Another exemplary embodiment provides for a different height for the raised annular apexes formed by the inclined surfaces, so that only a minimal surface is used as the armature stop face.

An annular cutout at the magnetic surface in the region of the solenoid coil brings about a positive influence on the hydraulic damping due to a local enlargement of the working gap.

DETAILED DESCRIPTION

Figure 1:
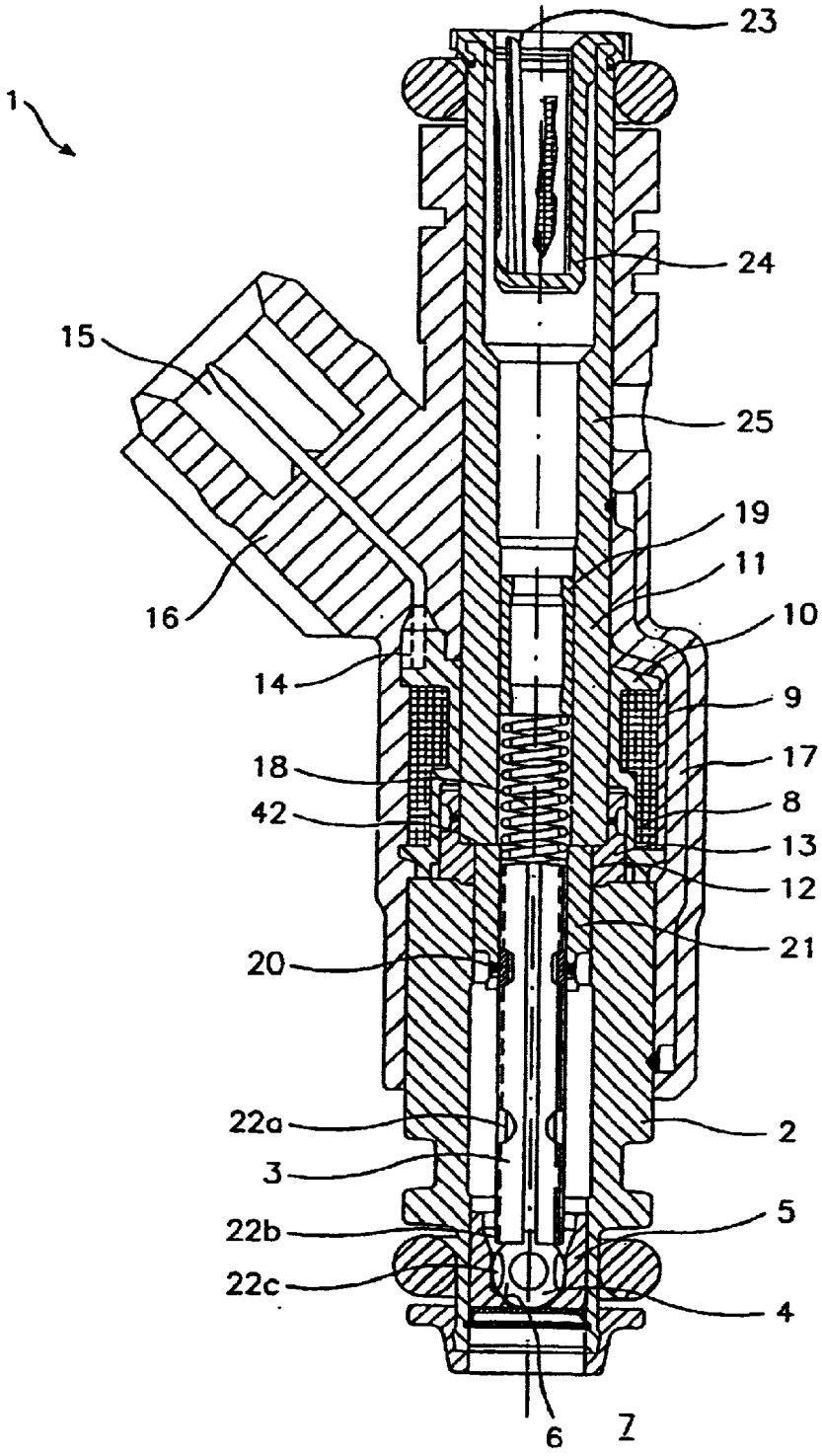
FIG. 1 shows an axial intersection through a fuel injector.

Before several exemplary embodiments of an armature of a fuel injector according to the present invention are described with reference to FIGS. 2 through 7, to better understand the invention, an available fuel injector is explained with respect to its important components with the aid of FIG. 1. Fuel injector 1 is designed in the form of an injector for fuel-injection systems of mixture-compressing internal combustion engines with externally supplied ignition. Fuel injector 1 is particularly suitable for injecting fuel into an intake manifold 7 of an internal combustion engine. However, the measures, described more precisely in the following, for reducing the hydraulic armature damping are equally suitable for high-pressure injectors injecting directly into a combustion chamber.

Fuel injector 1 includes a core 25 which is coated with a plastic extrusion coat 16. A valve needle 3 is connected to a valve-closure member 4 that cooperates with a valve-seat surface 6, arranged on a valve-seat member 5, to form a sealing seat. Fuel injector 1 in the exemplary embodiment is an inwardly opening fuel injector 1 which injects into an intake manifold 7. Core 25 forms an internal pole 11 of a magnetic flux circuit. A solenoid coil 8 is encased in plastic extrusion coat 16 and wound onto a coil brace 10 which abuts against core 25. Core 25 and a nozzle body 2, serving as external pole, are separated from one another by a gap 12 and are braced on a non-magnetic connecting member 13. Solenoid coil 8 is energized via an electric line 14 by an electric current which can be supplied via a plug-in contact 15. The magnetic flux circuit is closed by a, for example, U-shaped return member 17.

Braced against valve needle 3 is a return spring 18 which is prestressed by a sleeve 19 in the present design of fuel injector 1. Valve needle 3 is frictionally connected to an armature 21 via a welded seam 20.

The fuel is supplied through a central fuel feed 23 via a filter 24.

In the quiescent state of fuel injector 1, return spring 18 acts upon armature 21 contrary to its lift direction, such that valve-closure member 4 is retained in sealing contact against valve seat 6. When solenoid coil 8 is energized, it builds up a magnetic field which moves armature 21 in the lift direction against the spring tension of return spring 18. Armature 21 takes valve needle 3 along in the lift direction, as well. Valve-closure member 4, connected to valve needle 3, lifts off from valve-seat surface 6 and fuel is conducted via radial boreholes 22*a* in valve needle 3, a cutout 22*b* in valve-seat member 5 and flattenings 22*c* on valve-closure member 4 to the sealing seat.

When the coil current is switched off, after the magnetic field has sufficiently reduced, armature 21 falls off from internal pole 11 due to the pressure of return spring 18, whereby valve needle 3, connected to armature 21, moves contrary to the lift direction, valve-closure member 4 sits on valve-seat surface 6 and fuel injector 1 is closed.

Figure 2:
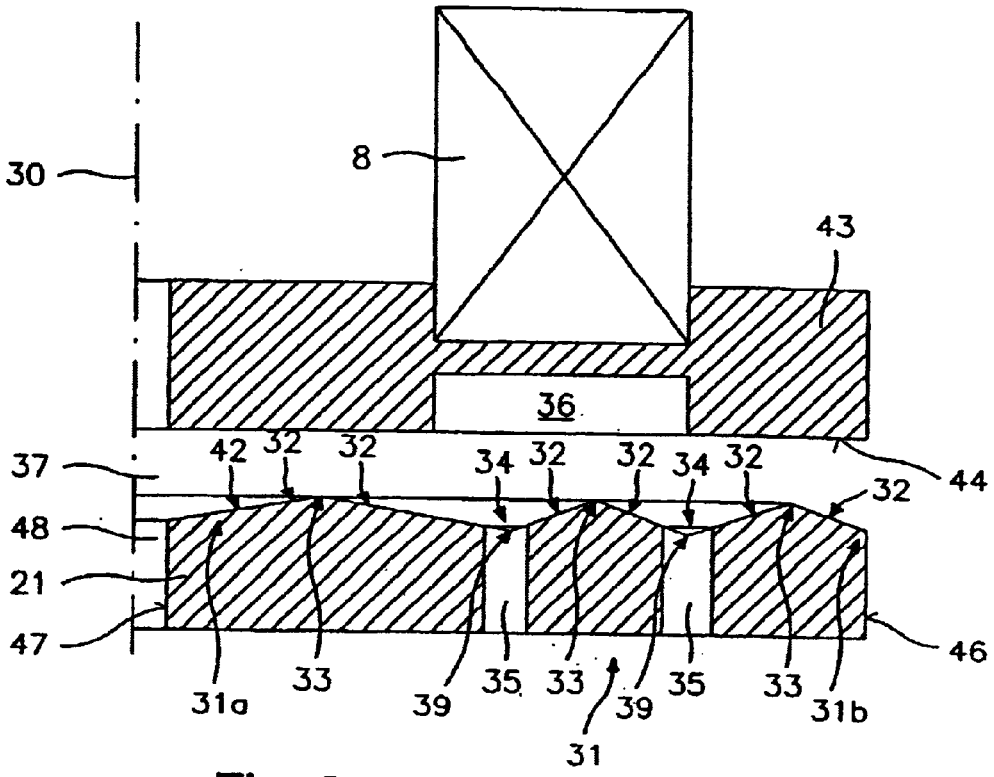
FIG. 2 shows a schematized, enlarged intersection through a first exemplary embodiment of an armature of a fuel injector according to the present invention.

FIG. 2, in a partial axial sectional view, shows a first exemplary embodiment of the design of fuel injector 1 according to the present invention. The form of any components not shown may correspond to that of the fuel injector 1 shown in FIG. 1. Elements already described are provided with corresponding reference numerals, so that a repetitious description is unnecessary.

Armature 21, already described in FIG. 1, is a so-called plunger armature 21 (solenoid plunger) in FIG. 1, is in the form of a flat armature 21 in FIGS. 2 through 7. In each case only one half of armature 21 to the right of symmetrical longitudinal axis 30 is shown in FIGS. 2 through 6.

In FIG. 2, armature 21 has two edge zones 31*a*, 31*b* which are distinguished by surfaces 32 inclined relatively to each other. Surface 32 of inner edge zone 31*a* is bounded by an inner edge 47 of flat armature 21 delimiting a central opening 48 and is inclined toward inner edge 47, while surface 32 of outer edge zone 31*b* is bounded by an outer edge 46 and is inclined toward outer edge 46.

Formed between edge zones 31*a*, 31*b* are two depressions 34 which in each case are distinguished by two inwardly inclined surfaces 32. Depressions 34 are connected to axial channels 35 which run parallel to longitudinal axis 30 of armature 21 and penetrate armature 21.

Situated in the region of solenoid coil 8 is a cutout 36 on a magnetic-pole surface 44 of a magnet body 43, the cutout being annular and locally enlarging a working gap 37 between armature stop face 42 and magnetic-pole surface 44. In this context, cutout 36 can extend up to solenoid coil 8. Instead of magnet body 43, a different component separating solenoid coil 8 from the fuel may be used.

When an excitation current is supplied to solenoid coil 8, armature 21 moves in the direction toward magnet body 43 and, in so doing, displaces the fuel present in working gap 37. The fuel is displaced via inclined surfaces 32 into channels 35 and to inner edge 47 and outer edge 46, and can flow off via armature 21. Due to the distribution of the fuel into channels 35 and into the outer and inner regions of armature 21, the fluid in working gap 37 flows off quickly and does not interfere with the opening operation of fuel injector 1.

Figure 3:
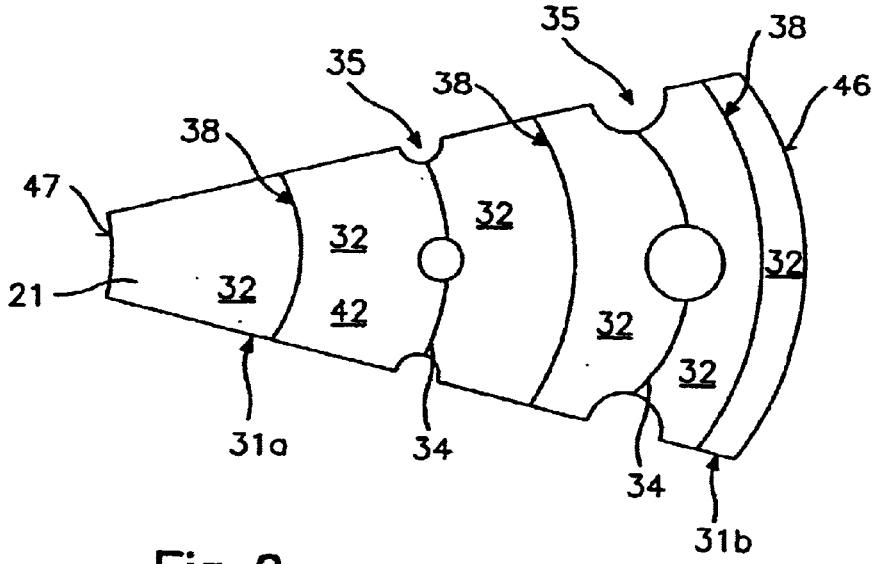
FIG. 3 shows a plan view of the stop face of the armature in FIG. 2.

FIG. 3, in a partial plan view, shows armature 21 (which may be like that of FIG. 1) of the exemplary embodiment in FIG. 2 according to the present invention.

Raised, concentric apexes 33, at which inclined surfaces 32 adjoin, form three annular remaining armature stop faces 38. Thus, at the end of the opening operation, armature 21 no longer strikes with entire armature stop face 42 against magnet body 43, but rather with annular remaining armature stop faces 38 formed by apexes 33. The closing operation is thereby accelerated, since smaller remaining armature stop face 38 also experiences a lesser hydraulic adhesion force and therefore armature 21 detaches itself more easily from magnet body 43.

Recessed, concentric apexes 39 lie in depressions 34. Evenly spaced in depressions 34 are channels 35 which penetrate armature 21 parallel to longitudinal axis 30 of armature 21. In this context, the diameter of channels 35 can also be variable, so that in each of depressions 34, variably dimensioned channels 35 are placed corresponding to the catchment (entrance) area and increase with the diameter.

The number and the dimension of channels 35 influence the flow behavior of the fuel considerably. That is why in FIG. 3, channels 35 with a larger diameter are shown in depression 34 lying closer to outer edge 46 of armature 21, and channels 35 with a smaller diameter are shown in depression 34 lying further inside. A particularly advantageous arrangement of channels 35 exists when they lie along one line in the radial direction.

Figure 4:
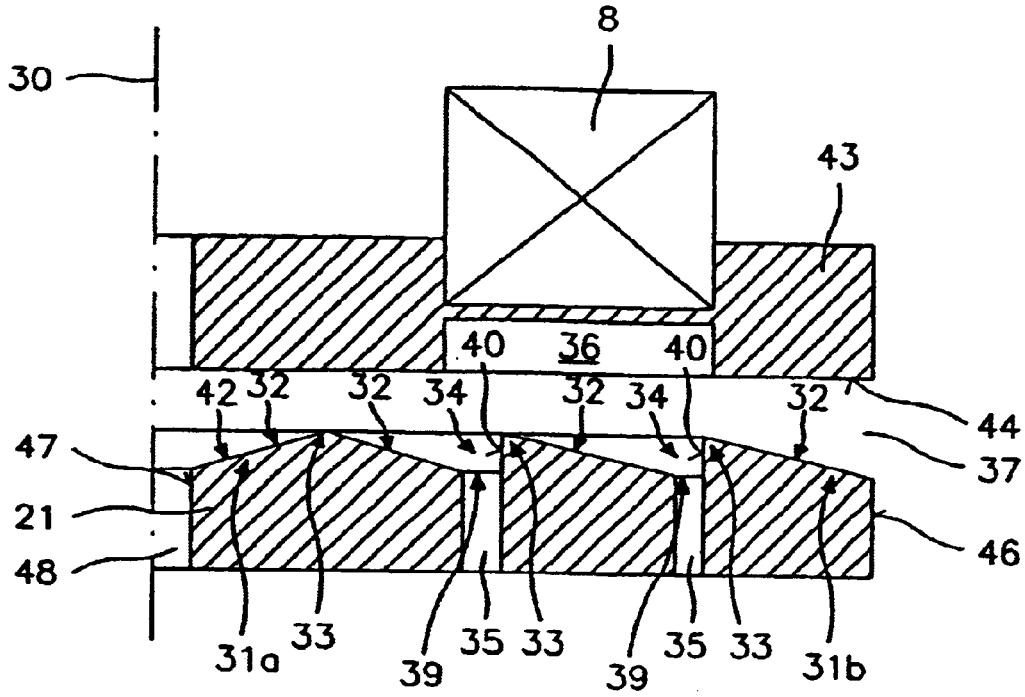
FIG. 4 shows a schematized, enlarged intersection through a second exemplary embodiment of an armature of a fuel injector according to the present invention.

FIG. 4, in a partial axial sectional view, shows a second exemplary embodiment of a fuel injector according to the present invention.

In contrast to FIG. 2, here depressions 34 are not made of two adjoining, inclined surfaces 32. Both depressions 34 have in each case one inclined surface 32 and one surface 40 running parallel to longitudinal axis 30 of armature 21. Channels 35 as well as annular cutout 36 of magnet body 43, the cutout being situated in the region of solenoid coil 8, are constructed as in the first exemplary embodiment in FIG. 2. The saw-tooth-shaped formation of depressions 34 is an exemplary embodiment of armature 21, which may be produced particularly easily.

Figure 5:
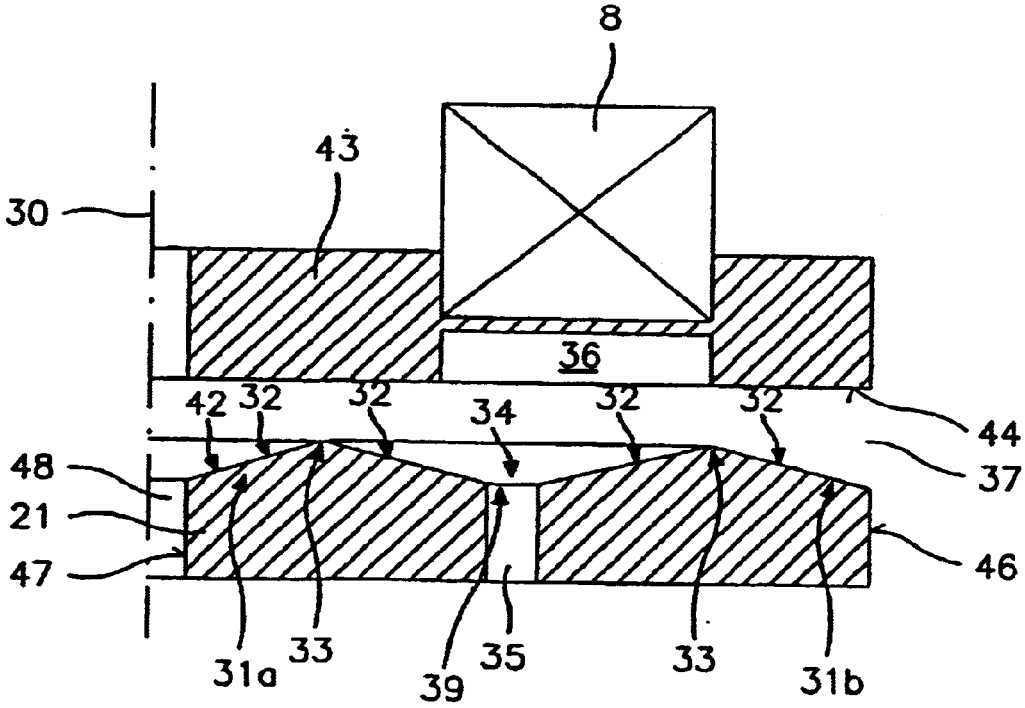
FIG. 5 shows a schematized, enlarged intersection through a third exemplary embodiment of an armature of a fuel injector according to the present invention.

FIG. 5, in a partial axial sectional view, shows a third exemplary embodiment of a fuel injector according to the present invention.

The exemplary embodiment described here is a simplified variant of the exemplary embodiment in FIG. 2. Armature stop face 42 has two edge zones 31*a*, 31*b* here, as well, which are each bounded by two surfaces 32 inclined relative to one another. Channels 35 are situated in the only intervening depression 34.

Figure 6:
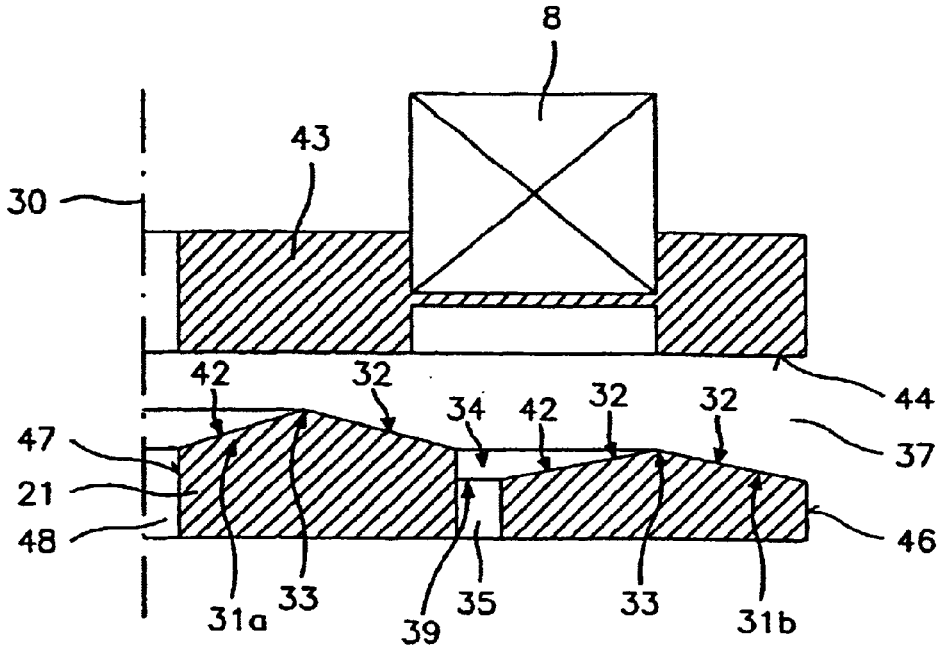
FIG. 6 shows a schematized, enlarged intersection through a fourth exemplary embodiment of an armature of a fuel injector according to the present invention.

FIG. 6, in a partial axial sectional view, shows a fourth exemplary embodiment of a fuel injector according to the present invention.

Compared to the design variant in FIG. 5, the form described in FIG. 6 is distinguished by a lowering of one of raised apexes 33. This results in a further reduction of effective armature stop face 38, which means armature 21 strikes at only one of apexes 33 and the adhesion of armature 21 on magnet body 43 is further reduced. In addition, the lowering of the one raised apex 33 enlarges working gap 37 there, which has a favorable effect on the flow behavior of the fuel present in working gap 37.

Figure 7:
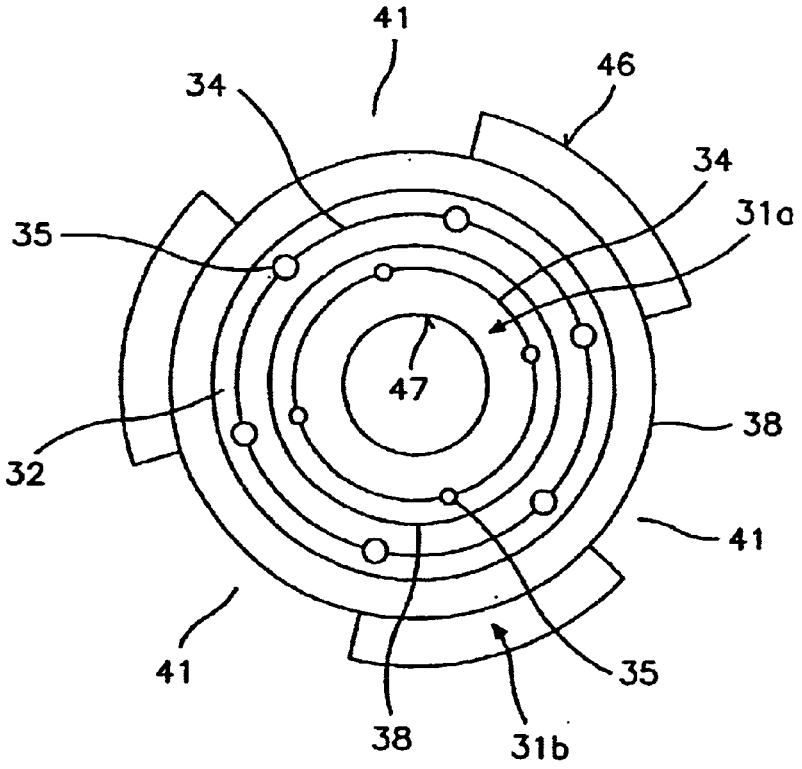
FIG. 7 shows a plan view of the armature stop face of a fifth exemplary embodiment of an armature of a fuel injector according to the present invention.

FIG. 7, in a top view of armature stop face 42, shows a fifth exemplary embodiment of a fuel injector according to the present invention.

To better distribute and carry away the fuel present in working gap 37, cutouts 41 are provided at outer edge 46 of armature 21. This likewise leads to a reduction of effective armature stop face 38, as well as a speedy displacement of the fuel on the edge side via inclined surface 32 of edge zone 31*b*.

The present invention may be implemented, as appropriate, for a number of other fuel-injector constructions, including those having plunger armatures.

What is claimed is:

1. A fuel injector for a fuel injection system of an internal combustion engine, comprising:

a solenoid coil;

an armature including an armature stop face, and including an outer edge and an inner edge bounding a central opening acting upon the armature in a closing direction, the armature striking with the armature stop face against a magnetic-pole surface;

a valve-closure member frictionally connecting to the armature and, together with a valve-seat surface, forming a sealing seat;

wherein the armature stop face includes a first annular, inner edge zone adjoining the inner edge and is inclined inwardly with respect to a plane perpendicular to a longitudinal axis of the armature, and includes a second annular, outside edge zone adjoining the outer edge and is inclined outwardly with respect to a plane perpendicular to the longitudinal axis of the armature.

2. The fuel injector of claim 1, wherein at least one depression is formed between the first and second annular, inclined edge zones.

3. The fuel injector of claim 2, wherein each of the at least one depression is bounded by two inclined surfaces oppositely inclined with respect to the plane perpendicular to the longitudinal axis of the armature.

4. The fuel injector of claim 2, wherein each of the at least one depression between the first and second annular, inclined edge zones is bounded by a first inclined surface inclined with respect to the plane perpendicular to the longitudinal axis of the armature, and a second surface running parallel to the longitudinal axis of the armature.

5. The fuel injector of claim 3, wherein the armature stop face includes raised apexes at which a distance between the armature stop face and the magnetic-pole surface is minimal, and recessed apexes at which another distance between the armature stop face and the magnetic-pole surface is maximal.

6. The fuel injector of claim 5, wherein axial channels penetrating the armature are placed at the recessed apexes.

7. The fuel injector of claim 6, wherein the distance is variable between the armature stop face and the magnetic-pole surface at the raised apexes.

8. The fuel injector of claim 1, wherein the armature includes at least one cutout at the outer edge of the armature.

9. A fuel injector for a fuel injection system of an internal combustion engine, comprising:

a solenoid coil;

an armature including an armature stop face, and including an outer edge and an inner edge bounding a central opening acting upon the armature in a closing direction, the armature striking with the armature stop face against a magnetic-pole surface;

a valve-closure member frictionally connecting to the armature and, together with a valve-seat surface, forming a sealing seat;

wherein the armature stop face includes a first annular, inner edge zone adjoining the inner edge and is inclined inwardly with respect to a plane perpendicular to a longitudinal axis of the armature, and includes a second annular, outside edge zone adjoining the outer edge and is inclined outwardly with respect to a plane perpendicular to the longitudinal axis of the armature; and wherein the armature includes at least one cutout at the outer edge of the armature.

10. The fuel injector of claim 4, wherein the armature stop face includes raised apexes at which a distance between the armature stop face and the magnetic-pole surface is minimal, and recessed apexes at which another distance between the armature stop face and the magnetic-pole surface is maximal.

* * * * *